US011326295B2

(12) United States Patent
Goshgarian

(10) Patent No.: US 11,326,295 B2
(45) **Date of Patent: *May 10, 2022**

(54) BASKET FOR A LAUNDRY TREATING APPLIANCE

(71) Applicant: WHIRLPOOL CORPORATION, Benton Harbor, MI (US)

(72) Inventor: David P. Goshgarian, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 130 days.

This patent is subject to a terminal disclaimer.

(21) Appl. No.: 16/801,565

(22) Filed: Feb. 26, 2020

(65) Prior Publication Data

US 2020/0190722 A1 Jun. 18, 2020

Related U.S. Application Data

(63) Continuation of application No. 15/712,728, filed on Sep. 22, 2017, now Pat. No. 10,597,808.

(51) Int. Cl.
*D06F 37/12* (2006.01)
*D06F 23/04* (2006.01)

(52) U.S. Cl.
CPC ..... *D06F 37/12* (2013.01); *D06F 23/04* (2013.01)

(58) Field of Classification Search
CPC ..... D06F 37/12; D06F 23/04
USPC ..... 68/23.1
See application file for complete search history.

(56) References Cited

U.S. PATENT DOCUMENTS

| | | | |
|---|---|---|---|
| 6,918,271 | B2 | 7/2005 | Lim et al. |
| 9,394,642 | B2 | 7/2016 | Mcmaster et al. |
| 9,574,297 | B2 | 2/2017 | Berndsen et al. |
| 2010/0251782 | A1 | 10/2010 | Mcmaster et al. |
| 2011/0048081 | A1 | 3/2011 | Urbiola Soto et al. |

*Primary Examiner* — Tinsae B Ayalew
(74) *Attorney, Agent, or Firm* — McGarry Bair PC

(57) ABSTRACT

A laundry treating appliance includes a tub defining a tub interior and a basket rotatably mounted within the tub interior. The basket can include an upper basket portion defining a basket interior, as well as a lower base portion coupled to the upper basket portion and including at least one spoke.

20 Claims, 5 Drawing Sheets

BASKET FOR A LAUNDRY TREATING APPLIANCE

CROSS REFERENCE TO RELATED APPLICATIONS

This application is a continuation of U.S. patent application Ser. No. 15/712,728, filed Sep. 22, 2017, now U.S. Pat. No. 10,597,808, issued on Mar. 24, 2020, all of which is hereby incorporated by reference in its entirety.

BACKGROUND

Laundry treating appliances, such as clothes washers, refreshers, and non-aqueous systems, can have a configuration based on a rotating laundry basket that defines a treating chamber in which laundry items are placed for treating. The laundry treating appliance can have a basket which defines a treating chamber into which laundry can be placed for treating operations. The basket can have at least a portion which is imperforate to allow fluid flow through the treating chamber.

BRIEF DESCRIPTION

In one aspect of the present disclosure, a laundry treating appliance includes a tub defining a tub interior, a basket rotatably mounted within the tub interior and including an upper basket portion having a peripheral wall defining a basket interior, a lower base portion coupled to the upper basket portion and comprising a hub, a rim, and a plurality of spaced ribs extending radially from the hub to the rim and having a first circumferential width, and a set of spaced axial support walls having a second circumferential width different from the first circumferential width and coupling the plurality of spaced ribs to the upper basket portion, wherein one of the set of spaced axial support walls couples one of the plurality of spaced ribs to define an I-shaped cross section.

Another aspect of the disclosure includes a laundry treating appliance, including a tub defining a tub interior and a basket rotatably mounted within the tub interior, the basket including an upper basket portion having a peripheral wall defining a basket interior, a lower base portion coupled to the upper basket portion and comprising a hub, a rim, and a plurality of spaced ribs extending radially from the hub to the rim and having a first circumferential width, and a set of spaced axial support walls having a second circumferential width different from the first circumferential width and coupling the plurality of spaced ribs to the upper basket portion, wherein the set of spaced axial support walls, the hub, and the rim define a plurality of air pockets between the upper basket portion and lower base portion with a first air pocket of the plurality of air pockets having has a different shape or size as compare to a second air pocket of the plurality of air pockets.

DETAILED DESCRIPTION

Figure 1:
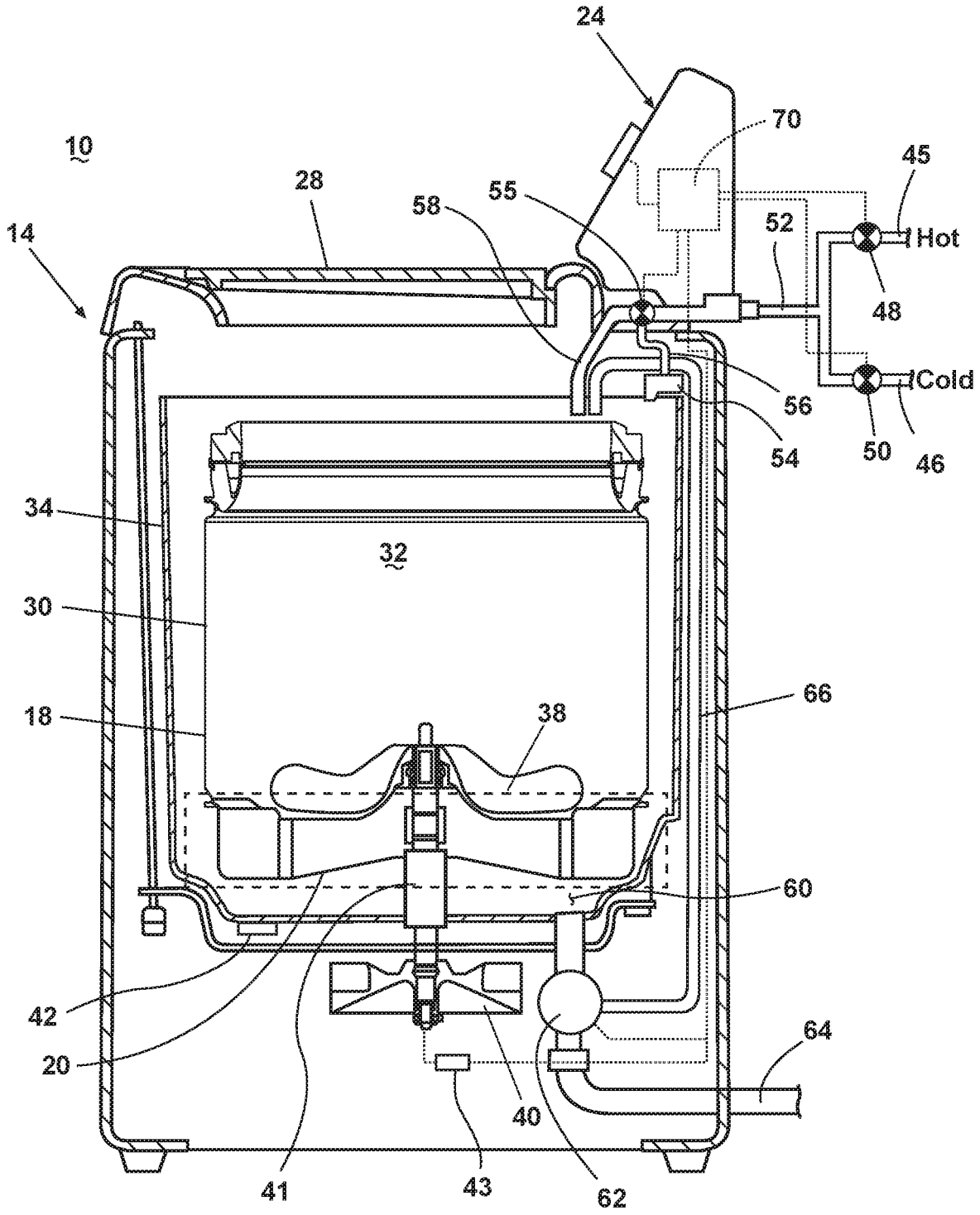
FIG. 1 is a schematic view of an exemplary laundry treating appliance in the form of a washing machine.
Figure 2:
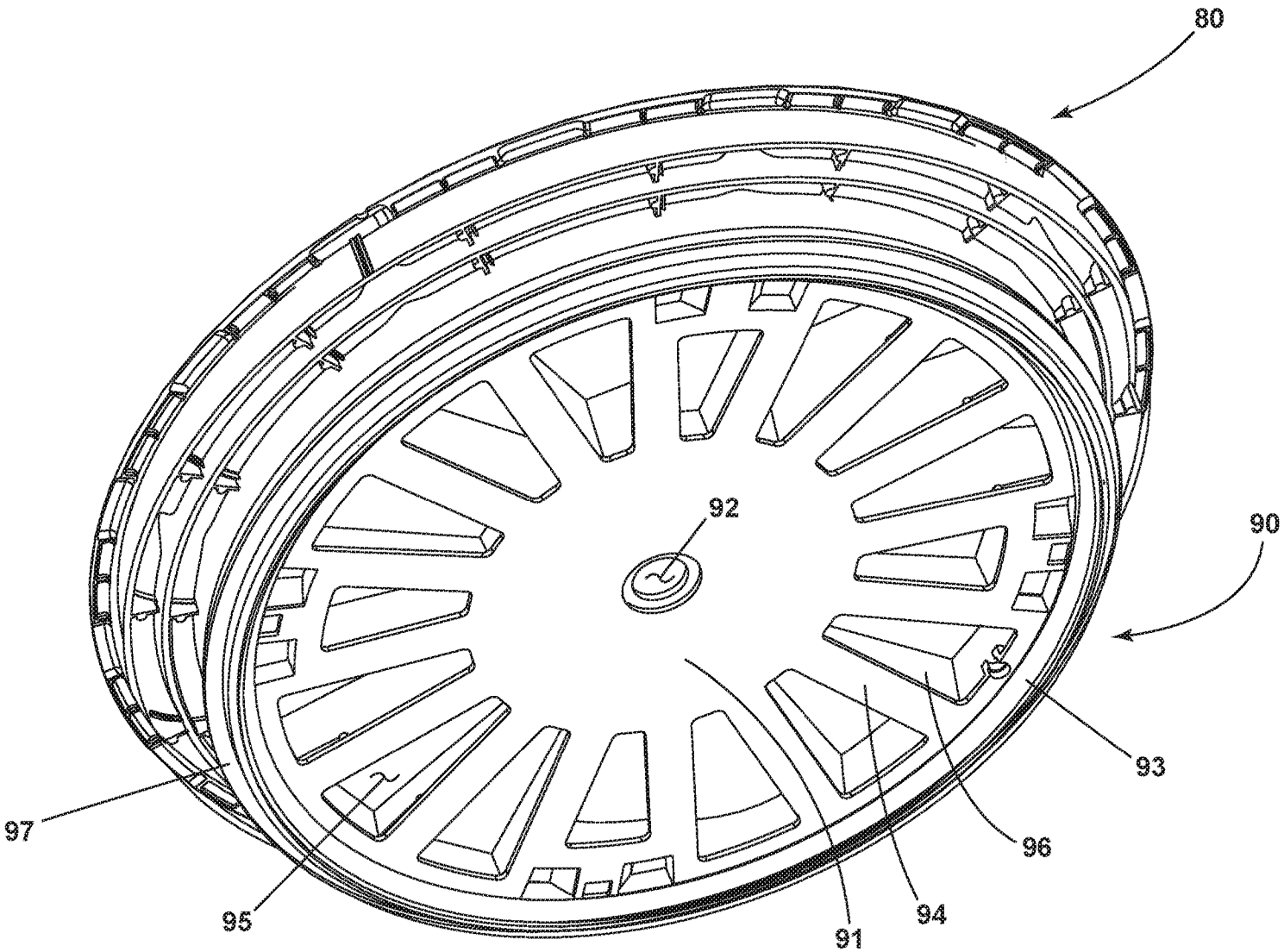
FIG. 2 is a perspective bottom view of a basket that can be utilized in the laundry treating appliance of FIG. 1.
Figure 3:
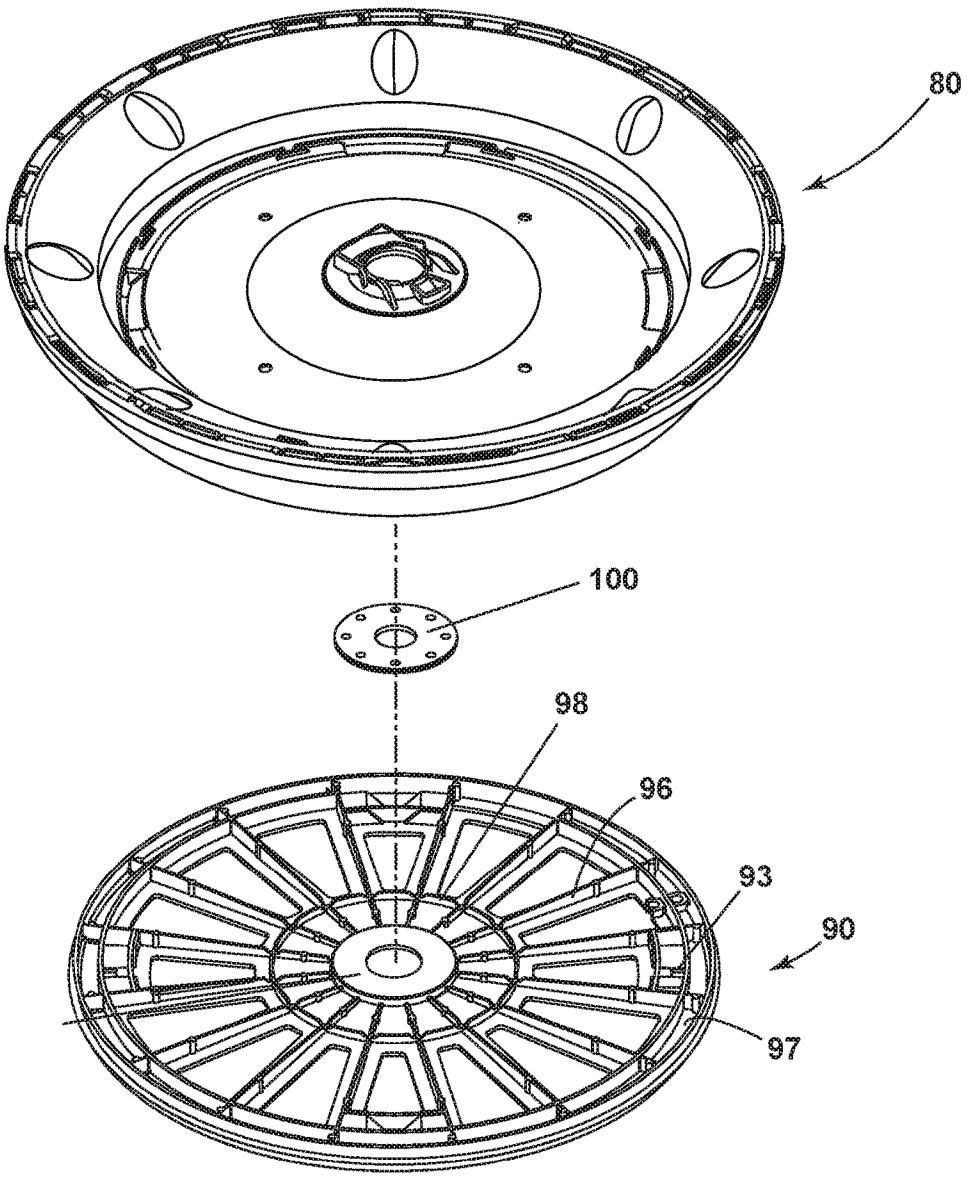
FIG. 3 is an exploded view of the basket of FIG. 2.
Figure 4:
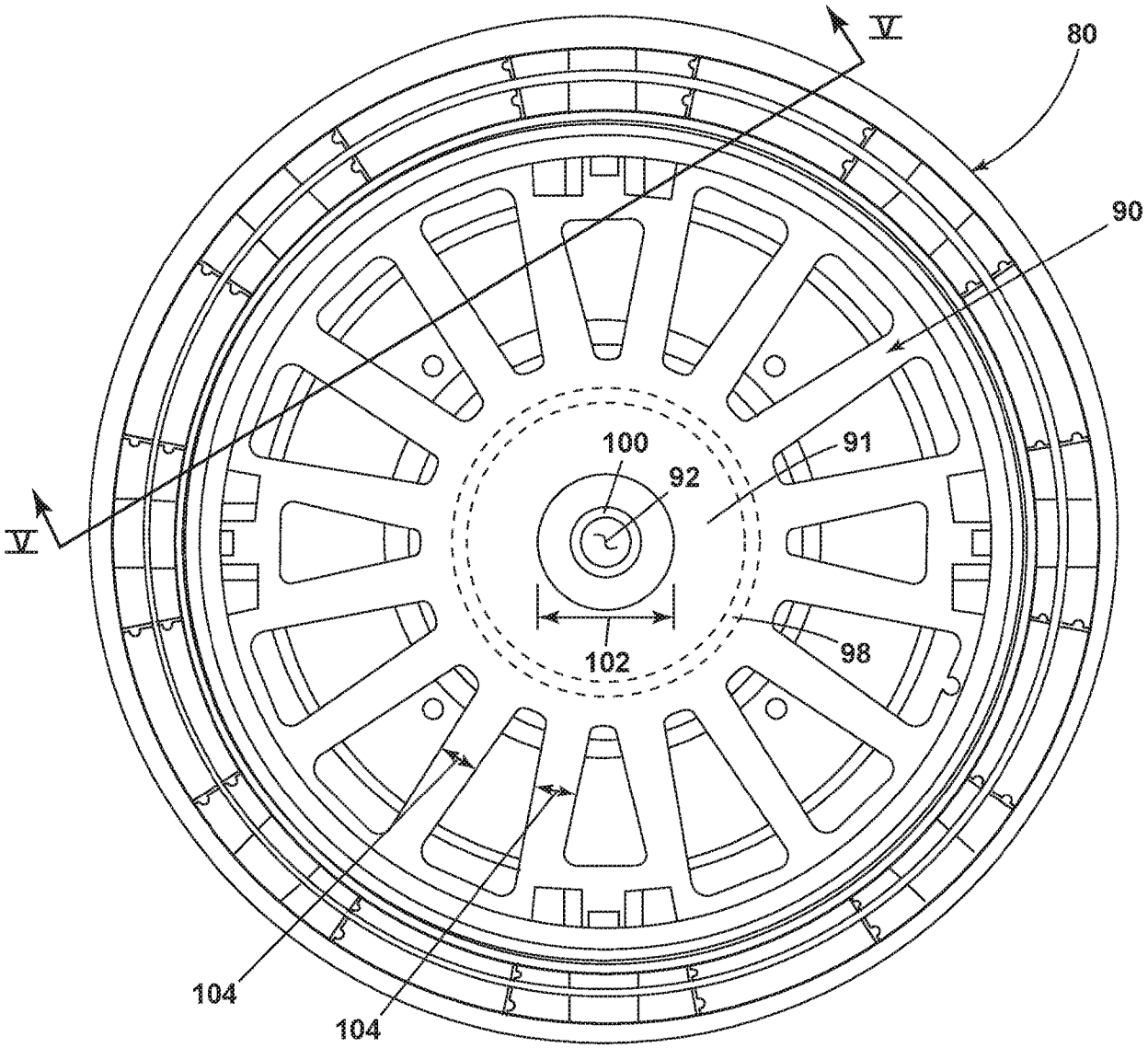
FIG. 4 is a bottom view of the basket of FIG. 2.
Figure 5:
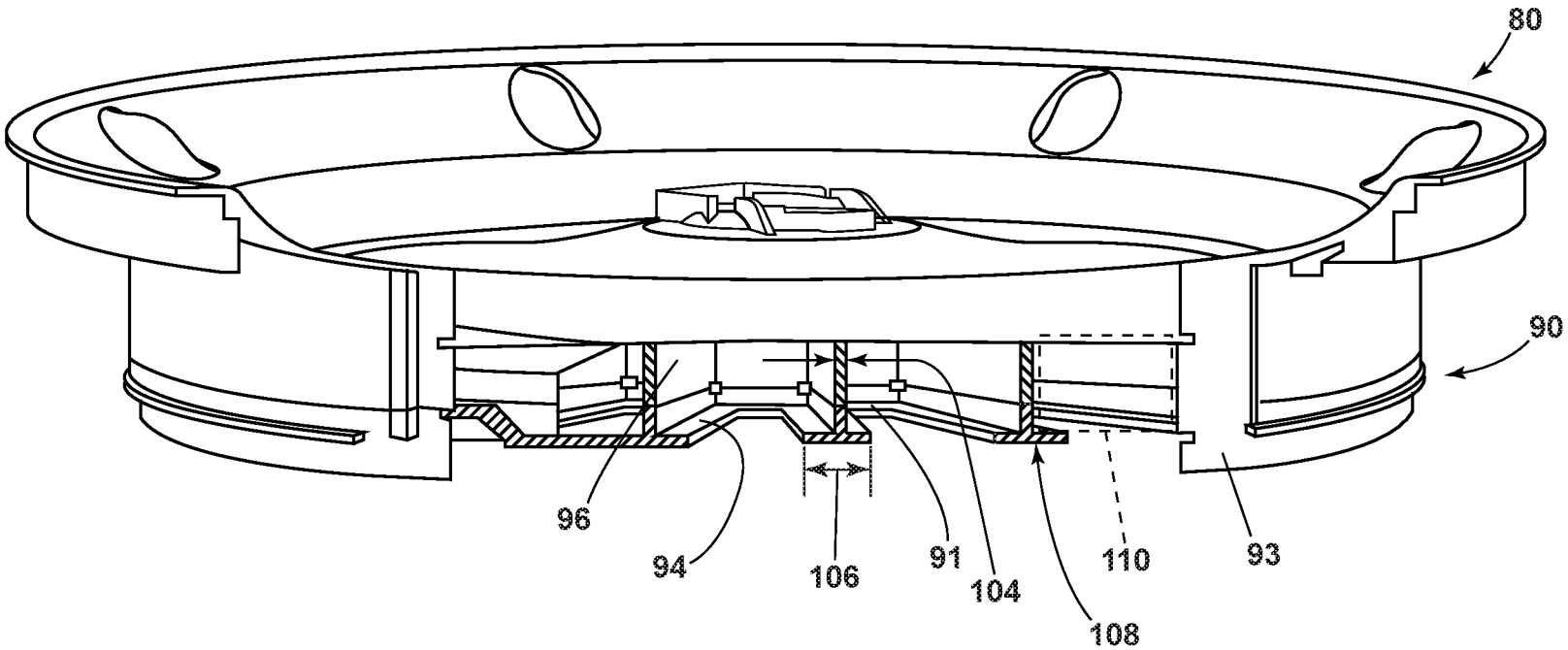
FIG. 5 is a cross-sectional view of the basket of FIG. 4 along the line V-V.

Aspects of the disclosure relate to a laundry treating appliance that includes a basket having at least a portion which is imperforate. By way of overview, FIG. 1 is illustrative of an example of a laundry treating appliance in the form of a washing machine that includes a structural support system, drive system, liquid supply system, recirculation and drain system, and dispensing system. The structural support system can include a cabinet, tub, and basket rotatably mounted within the tub for receipt of laundry items. FIG. 2 is illustrative of an exemplary basket that can be utilized within the laundry treating appliance. The basket can include a basket upper portion and lower base portion. A set of spokes in the lower base portion can extend in a radial direction and define a set of gaps in the intervening space between spokes. FIGS. 3-5 are illustrative of various aspects of the exemplary basket of FIG. 2, including internal structural components and dimensions. The gaps can allow for less material to be used in construction of the basket, thereby reducing the material costs in production, while the spokes can provide for structural stability of the basket.

In more detail, and referring again to FIG. 1, a schematic sectional view of a laundry treating appliance in the form of a washing machine 10 is illustrated according to one embodiment of the invention. While the laundry treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

The washing machine 10 can include a structural support system comprising a cabinet 14 that defines a housing, within which a laundry holding system resides. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention.

A user interface 24 may be included on the cabinet 14 and may have one or more knobs, dials, switches, displays, touch screens and the like for communicating with the user, such as to receive input and provide output. The user can enter different types of information including, without limitation, cycle selection and cycle parameters, such as cycle options. A door or lid 28 may be operably coupled with the cabinet 14 and may be selectively moveable between opened and closed positions to close an opening in a top wall of the cabinet 14, which provides access to the interior of the cabinet 14.

The fabric holding system of the illustrated exemplary washing machine 10 can include a rotatable basket 30 having an open top that can be disposed within the interior of the cabinet 14 and may define a treating chamber 32 for receiving laundry items for treatment. The basket 30 can have a generally cylindrical side or tub peripheral wall 18 closed at its bottom end by a basket bottom wall 20 that can at least partially define a sump 60 and the treating chamber 32. An imperforate tub 34 can also be positioned within the cabinet 14 and can define an interior within which the basket 30 can be positioned.

The basket 30 can be rotatably mounted within the tub 34 for rotation about a vertical basket axis of rotation and can include a plurality of perforations, such that liquid may flow between the tub 34 and the rotatable basket 30 through the perforations.

A laundry mover 38 may be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator. The basket 30 and the laundry mover 38 may be driven by a drive system 40 that includes a motor 41 operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A liquid supply system can be provided to supply liquid, such as water or a combination of water and one or more wash aids, such as detergent, into the treating chamber 32. The liquid supply system can include a water supply configured to supply hot or cold water. The water supply can include a hot water inlet 45 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the cabinet 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Referring now to FIG. 2, a lower region 35 of the basket 30 of the washing machine 10 is illustrated in further detail. The basket 30 can include an upper basket portion 80 having the basket bottom wall 20 as shown. The peripheral wall 18 can extend from the basket bottom wall 20 to define a basket interior 82, which can also define the treating chamber 32.

The lower region 35 of the basket 30 can include a lower base portion 90 having a solid hub 91 with a central hole 92, a rim 93 circumscribing the hub 91, and a set of radial ribs 94 extending radially between the hub 91 and rim 93. Intervening space between the radial ribs 94 can define a set of gaps 95; the positioning of the radial ribs 94, hub 91, and rim 93 can create a four-sided wedge profile for the gaps 95 as shown in the example of FIG. 2; other examples include three-sided or triangular profiles or oval profiles as desired. A set of axial support walls 96 can extend between the radial ribs 94 and basket bottom wall 20, thereby coupling the lower base portion 90 to the upper basket portion 80. In addition, a balance channel 97 can circumscribe the rim 93 and be coupled to the upper basket portion 80. Moveable masses or other suitable components can be positioned within the balance channel 97 to provide for load balancing during a spin operation.

It is contemplated that the upper basket portion 80 and lower base portion 90 can be formed as a single, monolithic component, including by injection molding. The basket portion 80 and base portion 90 can also be formed individually and coupled via welding, press fitting, or other suitable methods.

FIG. 3 is an exploded view of the components of the basket lower region 35 and illustrates a circumferential rib 98 positioned in the lower base portion 90 at least partially defining the hub 91. The circumferential rib 98 is illustrated with a set of notches 99 on either side of each intersection point of the circumferential rib 98 with an axial support wall 96; it is also contemplated that the circumferential rib 98 can intersect an axial support wall 96 without such notches. When assembled, the axial support walls 96 can be coupled to the upper basket portion 80.

Turning to FIG. 4, the lower region 35 of the basket 30 can be seen from an axial viewing perspective. The central hole 92 can have an outer diameter 102 as shown. It is contemplated that the hub 91 can extend from the outer diameter 102 to the circumferential rib 98 (shown in dashed lines). Each radial rib 94 can also have a first circumferential width 104, which is illustrated as generally across the center of each radial rib 94. It will be understood that the first circumferential width 104 can be defined at any point along a given radial rib 94, and in one example the first circumferential width 104 can be approximately 10 mm.

FIG. 5 illustrates a cross-sectional view of the basket lower region 35, where it can be seen that the axial support walls 96 can each have a second circumferential width 106. It is contemplated that the second circumferential width 106 of the axial support walls 96 can be smaller than the first circumferential width 104 of the radial ribs 94; in one example, the radial ribs 94 can have a first circumferential width of 10 mm while the axial support walls 96 can have a second circumferential width of 2 mm. In this manner the radial ribs 94 and axial support walls 96 can define a set of spokes 108 having a generally I-shaped cross section, where the spokes 108 extend between the hub 91 and the rim 93.

In operation, as water rises and fills the imperforate tub 34 (FIG. 1), the set of gaps 95 in the basket lower region 35 form air pockets and air can essentially become trapped between the upper basket portion 80 and lower base portion 90. The air pockets can help reduce the amount of water used for any wash load in the washing machine, as the air pockets aid in the displacement of water. In essence, as water fills the tub 34, less water is needed for the water level to fill to and reach the wash basket 30. In one non-limiting example, approximately one gallon of water can be saved per fill, and it can be appreciated that water savings can be based on the geometry of the basket lower region 35.

Aspects of the present disclosure can provide for a variety of benefits. It can be appreciated that the spokes can provide structural support and rigidity of the basket, where the axial support walls are supported by the radial ribs in operation. The air pockets formed in the gaps can provide for a reduction in water usage; one example included water savings of 1 gallon per fill cycle. Furthermore, the set of gaps can provide for a reduction in material usage as compared with traditional baskets that include perforations in otherwise solid bottom walls. The reduction in material usage can also reduce manufacturing costs of the basket; in one example a cost savings of $0.50 per basket could be accomplished. The gaps can be formed in a variety of shapes, as defined by the positioning and relative sizes of the set of spokes. Increasing the size of the gaps can maximize material savings for construction of the basket, while material is concentrated near the axial support walls by way of the radial ribs to optimize structural support.

It can be further appreciated that the larger circumferential width of the radial ribs, on the lower skin of the basket base, as compared to the width of the axial support walls can provide for optimization of structural support, as provided by the radial ribs, in addition to the material and cost savings as described above. Furthermore, the larger widths of the radial ribs can retain a greater volume of trapped air in the set of air pockets between the upper basket portion and lower base portion when compared to traditional open basket bases that can lose more of their trapped air during a wash cycle.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance, comprising:

a tub defining a tub interior; and a basket rotatably mounted within the tub interior, the basket comprising:

an upper basket portion having a peripheral wall defining a basket interior;

a lower base portion coupled to the upper basket portion and comprising a hub, a rim, and a plurality of spaced ribs extending radially from the hub to the rim and having a first circumferential width; and a set of spaced axial support walls having a second circumferential width different from the first circumferential width and coupling the plurality of spaced ribs to the upper basket portion, wherein one of the set of spaced axial support walls couples one of the plurality of spaced ribs to define an I-shaped cross section.

2. The laundry treating appliance of claim 1 wherein the upper basket portion further comprises a bottom and the peripheral wall extends from the bottom.

3. The laundry treating appliance of claim 1 wherein the set of spaced axial support walls and ribs define a set of spokes extending between the hub and the rim.

4. The laundry treating appliance of claim 3 wherein a plurality of spokes in the set of spokes has an I-shaped cross section.

5. The laundry treating appliance of claim 1 wherein the first circumferential width is greater than the second circumferential width.

6. The laundry treating appliance of claim 1 wherein the hub is solid.

7. The laundry treating appliance of claim 1, further comprising at least one circumferential rib on the lower base portion between the hub and rim.

8. The laundry treating appliance of claim 7, further comprising a central hole in the lower base portion.

9. The laundry treating appliance of claim 8 wherein the hub extends radially from an outer diameter of the central hole to the at least one circumferential rib.

10. The laundry treating appliance of claim 1 wherein the lower base portion further comprises a balance channel circumscribing the rim.

11. The laundry treating appliance of claim 10 wherein the balance channel is coupled to the upper basket portion.

12. The laundry treating appliance of claim 1 wherein the set of spaced axial support walls, the hub, and the rim define at least one air pocket between the upper basket portion and the lower base portion.

13. The laundry treating appliance of claim 1 wherein the lower base portion and the upper basket portion are integrally constructed to form a single piece.

14. A laundry treating appliance, comprising:

a tub defining a tub interior; and a basket rotatably mounted within the tub interior, the basket comprising:

an upper basket portion having a peripheral wall defining a basket interior;

a lower base portion coupled to the upper basket portion and comprising a hub, a rim, and a plurality of spaced ribs extending radially from the hub to the rim and having a first circumferential width; and a set of spaced axial support walls having a second circumferential width different from the first circumferential width and coupling the plurality of spaced ribs to the upper basket portion, wherein the set of spaced axial support walls, the hub, and the rim define a plurality of air pockets between the upper basket portion and lower base portion with a first air pocket of the plurality of air pockets having a different shape or size as compared to a second air pocket of the plurality of air pockets.

15. The laundry treating appliance of claim 14 wherein the upper basket portion further comprises a bottom and the peripheral wall extends from the bottom.

16. The laundry treating appliance of claim 14 wherein the set of spaced axial support walls and ribs define a set of spokes extending between the hub and the rim.

17. The laundry treating appliance of claim 16 wherein at least one of positioning or relative size of at least one spoke of the set of spokes results in a change in the shape or size of at least one adjacent air pocket.

18. The laundry treating appliance of claim 17, further comprising a central hole in the lower base portion.

19. The laundry treating appliance of claim 14 wherein the lower base portion further comprises a balance channel circumscribing the rim.

20. The laundry treating appliance of claim 19 wherein the balance channel is coupled to the upper basket portion.

* * * * *